US007518310B2

(12) United States Patent
Yoo et al.

(10) Patent No.: US 7,518,310 B2
(45) Date of Patent: Apr. 14, 2009

(54) PLASMA DISPLAY PANEL

(75) Inventors: Hun-Suk Yoo, Cheonan-si (KR); Won-Ju Yi, Asan-si (KR); Kyoung-Doo Kang, Seoul (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 640 days.

(21) Appl. No.: 10/996,041

(22) Filed: Nov. 24, 2004

(65) Prior Publication Data

US 2005/0116646 A1 Jun. 2, 2005

(30) Foreign Application Priority Data

Nov. 29, 2003 (KR) ..... 10-2003-0086069

(51) Int. Cl.
*H01J 17/49* (2006.01)

(52) U.S. Cl. ..... 313/585; 313/584; 313/587

(58) Field of Classification Search ..... 313/581–587
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,744,909 | A * | 4/1998 | Amano | 313/585 |
| 5,786,794 | A | 7/1998 | Kishi et al. | |
| 5,808,413 | A * | 9/1998 | Bongaerts et al. | 313/585 |
| 5,952,782 | A | 9/1999 | Nanto | |
| 6,060,827 | A * | 5/2000 | Kichimi et al. | 313/582 |
| RE37,444 | E | 11/2001 | Kanazawa | |
| 6,339,292 | B1 * | 1/2002 | Ha | 313/582 |
| 6,630,916 | B1 | 10/2003 | Shinoda | |

(Continued)

FOREIGN PATENT DOCUMENTS

JP 48-71967 9/1973

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Ashok Patel
(74) *Attorney, Agent, or Firm*—Robert E. Bushnell, Esq.

(57) ABSTRACT

A plasma display panel capable of being fast driven with low voltage by reducing a distance between an address electrode and a Y electrode. The plasma display panel includes a pair of substrates, discharge electrodes, and an address electrode. The substrates are arranged at a predetermined interval to face each other and form a plurality of discharge spaces between facing surfaces of the substrates. The discharge electrodes are arranged at predetermined intervals between the substrates. The address electrode is arranged a predetermined distance apart from the discharge electrodes in a direction where the substrates are arranged, and defines each of the discharge spaces in cooperation with the discharge electrodes.

25 Claims, 9 Drawing Sheets

U.S. PATENT DOCUMENTS

| | | | |
|---|---|---|---|
| 6,657,397 | B2 | 12/2003 | Lee et al. |
| 6,707,436 | B2 | 3/2004 | Setoguchi et al. |

FOREIGN PATENT DOCUMENTS

| | | |
|---|---|---|
| JP | 02-148645 | 6/1990 |
| JP | 05-121001 | 5/1993 |
| JP | 08-045433 | 2/1996 |
| JP | 2845183 | 10/1998 |
| JP | 2917279 | 4/1999 |
| JP | 2001-043804 | 2/2001 |
| JP | 2001-325888 | 11/2001 |
| KR | 10-0212728 | 5/1999 |
| KR | 10-0279255 | 10/2000 |
| KR | 10-2001-0035878 | 5/2001 |

OTHER PUBLICATIONS

Korean Office Action of the Korean Patent Application No. 10-2003-0086069, mailed on Feb. 28, 2006.

Japanese Office Action corresponding to Patent Application No. 2004-334311, issued on Nov. 6, 2007.

*Office Action* from the Japanese Patent Office issued in Applicant's corresponding Japanese Patent Application No. 2004-334311 dated Mar. 4, 2008.

* cited by examiner

PLASMA DISPLAY PANEL

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 29 Nov. 2003 and thereby duly assigned Ser. No. 2003-86069.

BACKGROUND OF THE INVENTION

1. Field of the Invention

The present invention relates to a plasma display panel, and more particularly, to a design for a plasma display panel that is capable of being driven using only low voltages at a high speed by reducing a distance between an address electrode and a Y electrode.

2. Description of the Related Art

A plasma display panel (PDP) display, which is a recent flat panel display, has excellent characteristics, such as the display of a quality image, being extremely thin and light, providing a wide viewing angle while having a large screen. In addition, a PDP display can be more simply manufactured than other flat panel display devices, and be easily enlarged, such that the PDP display is spotlighted as a next-generation flat panel display device.

Turning now to FIGS. 1 and 2, FIGS. 1 and 2 are views of panel 1 of FIGS. 1 and 2 of U.S. Pat. No. 6,657,397 to Lee et al. FIG. 1 is an internal perspective view of the 3-electrode surface discharge PDP 1 and FIG. 2 is a cross-section of a unit display cell of the panel 1 of FIG. 1. Referring to FIGS. 1 and 2, address electrode lines $A_{R1}, A_{G1}, \ldots, A_{Gm}$, and $A_{Bm}$, front and rear dielectric layers 11 and 15, Y electrode lines $Y_1, \ldots$, and $Y_n$, X electrode lines $X_1, \ldots$, and $X_n$, phosphor layer 16, barrier ribs 17, and a MgO protective layer 12 are arranged between front and rear glass substrates 10 and 13 of the typical 3-electrode surface discharge PDP 1.

The address electrode lines $A_{R1}, A_{G1}, \ldots, A_{Gm}$, and $A_{Bm}$ are arranged in a predetermined pattern on rear glass substrate 13. The rear dielectric layer 15 covers the address electrode lines $A_{R1}, A_{G1}, \ldots, A_{Gm}$, and $A_{Bm}$. The barrier ribs 17 are formed on the front surface of the rear dielectric layer 15 to be parallel to the address electrode lines $A_{R1}, A_{G1}, \ldots, A_{Gm}$, and $A_{Bm}$. The barrier ribs 17 define discharge areas of each discharge cell and prevent optical crosstalk between adjacent discharge cells. The phosphor layers 16 are coated between barrier ribs 17.

The X electrode lines $X_1, \ldots$, and $X_n$ and the Y electrode lines $Y_1, \ldots$, and $Y_n$ are patterned on a rear surface of the front glass substrate 10 in a direction that is orthogonal to the address electrode lines $A_{R1}, A_{G1}, \ldots, A_{Gm}$, and $A_{Bm}$. The respective intersections define corresponding discharge cells. The X electrode lines $X_1, \ldots$, and $X_n$ and the Y electrode lines $Y_1, \ldots$, and $Y_n$ each have a transparent electrode line made of a conductive material, such as, indium tin oxide (ITO), and a metal electrode line of high conductivity. For example, as illustrated in FIG. 2, the X electrode line $X_n$ is made out of a transparent electrode line $X_{na}$ and a metal electrode line $X_{nb}$, and the X electrode line $Y_n$ is made up of a transparent electrode line $Y_{na}$ and a metal electrode line $Y_{nb}$. The front dielectric layer 11 is entirely coated over the X electrode lines $X_1, \ldots$, and $X_n$ and the Y electrode lines $Y_1, \ldots$, and $Y_n$. The MgO protective layer 12 for protecting the panel 1 against strong electric fields is coated over the entire rear surface of the front dielectric layer 11. Discharge spaces 14 are sealed with a gas for forming plasma.

As illustrated in FIG. 1, in the 3-electrode surface discharge PDP 1, not only the X electrode lines $X_1, \ldots$, and $X_n$, the Y electrode lines $Y_1, \ldots$, and $Y_n$ are formed on the rear surface of the front substrate, but also the dielectric layer 11 and the protective layer 12 are formed on the front glass substrate 10 over the X and Y electrodes. During discharge, visible rays emitted from the phosphors 16 in the discharge spaces 14 pass through the front substrate 10. However, the 3-electrode surface discharge PDP 1 has a significant problem in that only about 60% of the visible rays are transmitted through the front substrate 10 because of various components formed on the front substrate 10.

In the 3-electrode surface discharge PDP 1, electrodes that cause the discharge are formed over the discharge spaces 14, namely, on the inner or rear surface of the front substrate 10 through which the visible rays pass, such that the discharge is generated on the inner surface thereof and spreads. Hence, the 3-electrode surface discharge PDP 1 has low luminescent efficiency. These electrodes formed on the inner surface of the front substrate tend to block some of the visible rays generated, thus leading to losses. Further, when the 3-electrode surface discharge PDP 1 is used for a long period of time, charged particles of a discharge gas cause ion sputtering of the phosphor layers due to an electric field, thus generating a permanent residual image.

Furthermore, in the 3-electrode surface discharge PDP 1 of FIG. 1, the address electrode $A_{Gm}$ is formed on the rear glass substrate 13 to have a distance of about 130 to 160 μm from the X and Y electrode lines $X_n$ and $Y_n$ on the front substrate 10. Accordingly, an address voltage of 60 to 80V is applied to an address electrode that is arranged in a discharge cell to be selected during an addressing period, and a scan voltage of −60 to −80V is applied to a Y electrode that is arranged in the discharge cell to be selected during the addressing period. In other words, a great distance between the address electrode and the Y electrode requires a very large voltage, which requires high power consumption.

As illustrated in FIG. 1, a distance between an address electrode and a Y electrode depends on a height $h_w$ of each of the barrier ribs 17. When the height $h_w$ of each of the barrier ribs 17 is decreased to enhance address discharge characteristics, the overall brightness of the panel 1 is reduced due to a decrease in the amount of to-be-coated phosphor. In other words, when the height $h_w$ of each of the barrier ribs 17 is decreased by about 10 μm, the overall brightness of the panel 1 is reduced about 5 to 10%. Thus, attempts to lower power consumption by reducing barrier rib height can deteriorate the image quality. If the barrier ribs are made shorter to lower the power consumption, brightness suffers. If the barrier ribs are made high, the distance between the address and the Y electrodes increase leading to higher power consumption.

SUMMARY OF THE INVENTION

It is therefore an object of the present invention to provide an improved design for a PDP.

It is also an object to provide a design for a plasma display panel that is capable of being driven with low voltage and at high speed by reducing a distance between an address electrode and a Y electrode without decreasing the distance between the substrates.

It is further an object of the present invention to provide a design for a PDP where a gap between the address electrodes and the discharge electrodes is reduced without incurring any degradation in image quality.

These and other objects can be achieved by a plasma display panel that has a pair of substrates separated by a predetermined distance from each other, forming a plurality of discharge spaces between the two substrates. Barrier ribs and possibly upper sidewalls are formed between the substrates keeping the substrates separated from each other by a distance, the address electrodes and the Y electrodes being formed on or within the barrier ribs and/or the upper sidewalls. The barrier ribs and possibly the upper sidewalls dividing the space between the two substrates into many discharge spaces or discharge cells. By doing so, the distance between the Y electrodes and the address electrodes can be shortened to any distance while the substrates are kept apart from each other by a distance that can be much more than the distance between the Y electrodes and the address electrodes.

According to another aspect of the present invention, there is provided a plasma display panel that has a front substrate and a rear substrate separated by a predetermined distance and facing each other, at least one barrier rib partitioning a space formed between the front and rear substrates into a plurality of discharge spaces, discharge electrodes arranged at predetermined intervals on the barrier rib in a substrate direction (i.e., a direction substantially perpendicular or normal to the surface of the substrate) going from the front substrate to the rear substrate such that the discharge electrodes are parallel to each other, and an address electrode arranged a predetermined distance apart from the discharge electrodes, the barrier ribs defining each of the discharge spaces in cooperation with the discharge electrodes.

According to another aspect of the present invention, there is provided a plasma display panel having a pair of substrates separated by a predetermined distance and facing each other, at least one barrier rib partitioning a space formed between the substrates into a plurality of discharge spaces, discharge electrodes arranged at predetermined intervals between the substrates, an address electrode arranged a predetermined distance apart from the discharge electrodes and running in a direction where the substrates are arranged (i.e., in a direction substantially perpendicular or normal to the surface of the substrate), the barrier ribs defining each of the discharge spaces in cooperation with the discharge electrodes, a dielectric layer coated over the barrier rib on which the discharge electrodes and the address electrode are arranged, a protective layer formed on the dielectric layer to protect the dielectric layer, and a phosphor layer coated within the discharge space. The discharge electrodes and the address electrodes are arranged at a predetermined interval in a direction normal to the surface of the substrate between the two substrates. Although the discharge and address electrodes preferably run parallel to the substrates, the discharge and address electrodes may be extended in other directions.

According to another aspect of the present invention, there is provided a plasma display panel having a front substrate and a rear substrate facing each other and separated by a predetermined distance, at least one barrier rib partitioning a space formed between the front and rear substrates into a plurality of discharge spaces, discharge electrodes arranged at predetermined intervals in a space between the barrier rib and the front substrate, in a substrate direction going from the front substrate to the barrier rib, an address electrode arranged a predetermined distance apart from the discharge electrodes in the substrate direction, defining each of the discharge spaces in cooperation with the discharge electrodes and phosphor coated within the discharge space. The discharge electrodes and the address electrodes are disposed at a predetermined interval in a direction normal to the surface of the substrate between the two substrates. Although the discharge and address electrodes preferably run parallel to the substrates, the discharge and address electrodes may be extended in other directions.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate same or similar components, wherein.

DETAILED DESCRIPTION OF THE INVENTION

Figure 3:
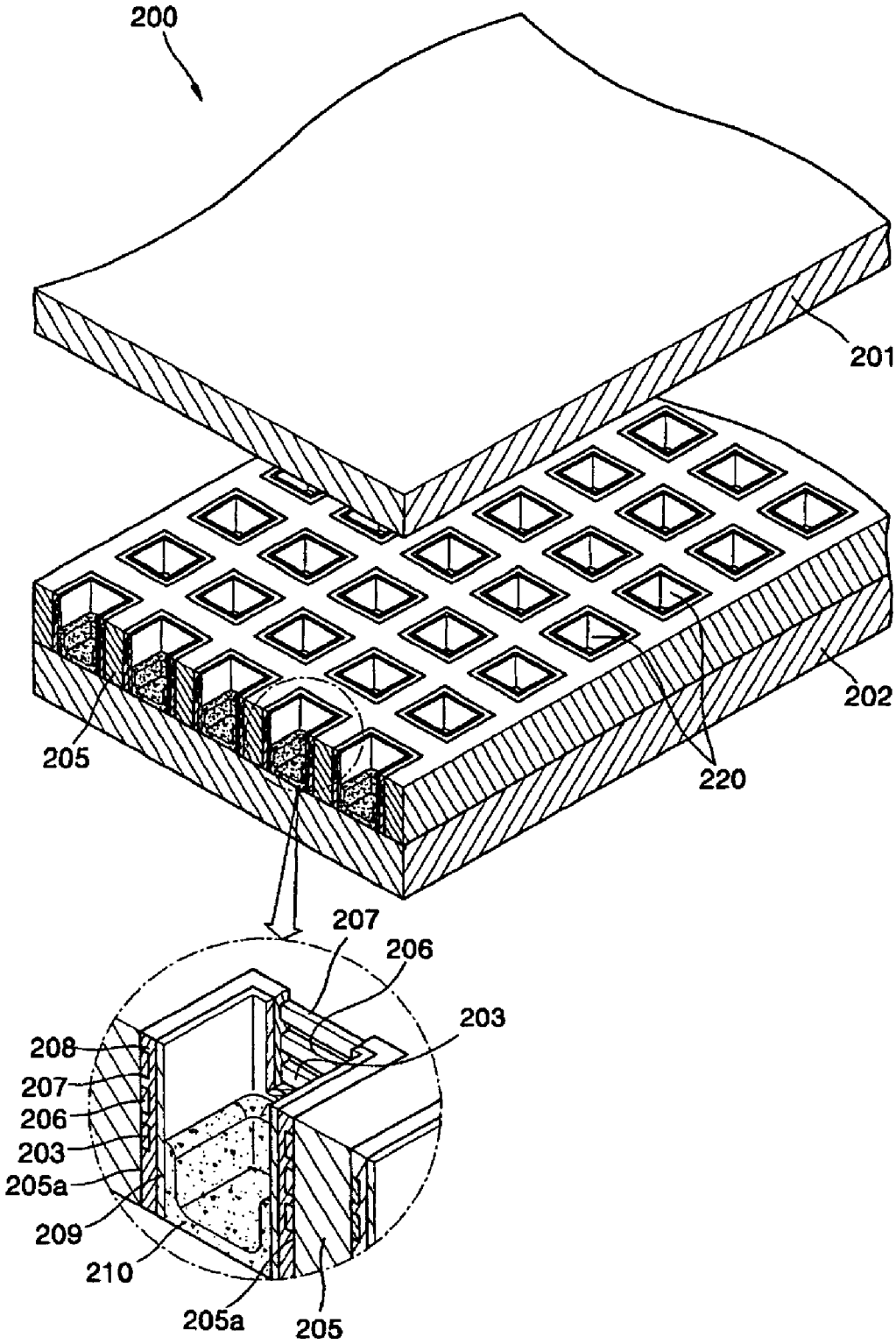
FIG. 3 is an exploded perspective view of a part of a PDP according to an embodiment of the present invention.

Turning now to FIGS. 3 through 8, these figures illustrate PDPs 200, 300 and 400 according to embodiments of the present invention. Referring to FIG. 3, a plasma display panel 200 according to an embodiment of the present invention includes a front substrate 201 facing a rear substrate 202 and spaced apart from each other by a predetermined distance. Barrier ribs 205 divide a space between the substrates into a plurality of discharge spaces 220. The barrier ribs 205 may be arranged in various patterns as long as the discharge spaces 220 can be formed. For example, the barrier ribs 205 may be not only open barrier ribs, such as strips, but also closed barrier ribs, such as ribs forming a waffle, a matrix, a delta shape, or the like. In FIGS. 3 through 8, the barrier ribs are illustrated as being closed barrier ribs, and the closed barrier ribs 205 are formed such that each of the discharge spaces 220 has a rectangular horizontal cross-section. However, the horizontal cross-section of each of the discharge spaces 220 can instead be polygonal (e.g., triangular, pentagonal, or the like), circular, oval, or the like.

The barrier ribs 205 define discharge spaces and also serve as a base to support the discharge electrodes 206 and 207. Accordingly, the barrier ribs 205 may be formed in any shape as long as the discharge electrodes 206 and 207 can be arranged so that discharge is initiated and spreads. For example, a lateral side (or barrier rib sidewall) 205*a* of each of the barrier ribs 205 may extend either perpendicularly to the front substrate 201 or aslant with respect to the direction perpendicular to the front substrate 201. Alternatively, the barrier sidewalls 205*a* may be curved in such a way that one end extends aslant in one direction and the other end extends aslant in the opposite direction.

Depending on various shapes of the barrier ribs 205, the discharge electrodes 206 and 207 may be arranged in various patterns on the barrier rib sidewalls 205*a* of barrier ribs 205. Various types of discharge can start and spread depending on various shapes of a discharge surface formed by the discharge electrodes 206 and 207. To apply a voltage that selects a discharge space 220 where discharge is to start, address electrodes 203 may be arranged in a predetermined pattern, for example, in a striped pattern on the rear substrate 202 such as to correspond to each of the discharge spaces 220. The pattern of the address electrodes 203 is not limited to the striped pattern but may have various other shapes depending on the shape of the discharge spaces 220.

Although the address electrodes 203 may be arranged on the rear substrate 202, they may be arranged at a different suitable location, such as, on the front substrate 201, on the barrier ribs 205, and the like. The address electrodes 203 may be unnecessary because the voltage that selects the discharge space 220 where discharge is to start can be applied to a space between the discharge electrodes 206 and 207 by appropriately arranging the discharge electrodes 206 and 207, for example, by crossing them. As illustrated in FIG. 3, the address electrodes 203 are not arranged on the rear substrate but are arranged on the sidewalls of the barrier ribs 205 along with the discharge electrodes, and spaced a predetermined distance apart from the discharge electrodes 206 and 207 on the barrier ribs 205. In the present embodiment, a rear dielectric layer is optional. However, a rear dielectric layer formed on a rear substrate may be included as in a PDP.

Figure 6:
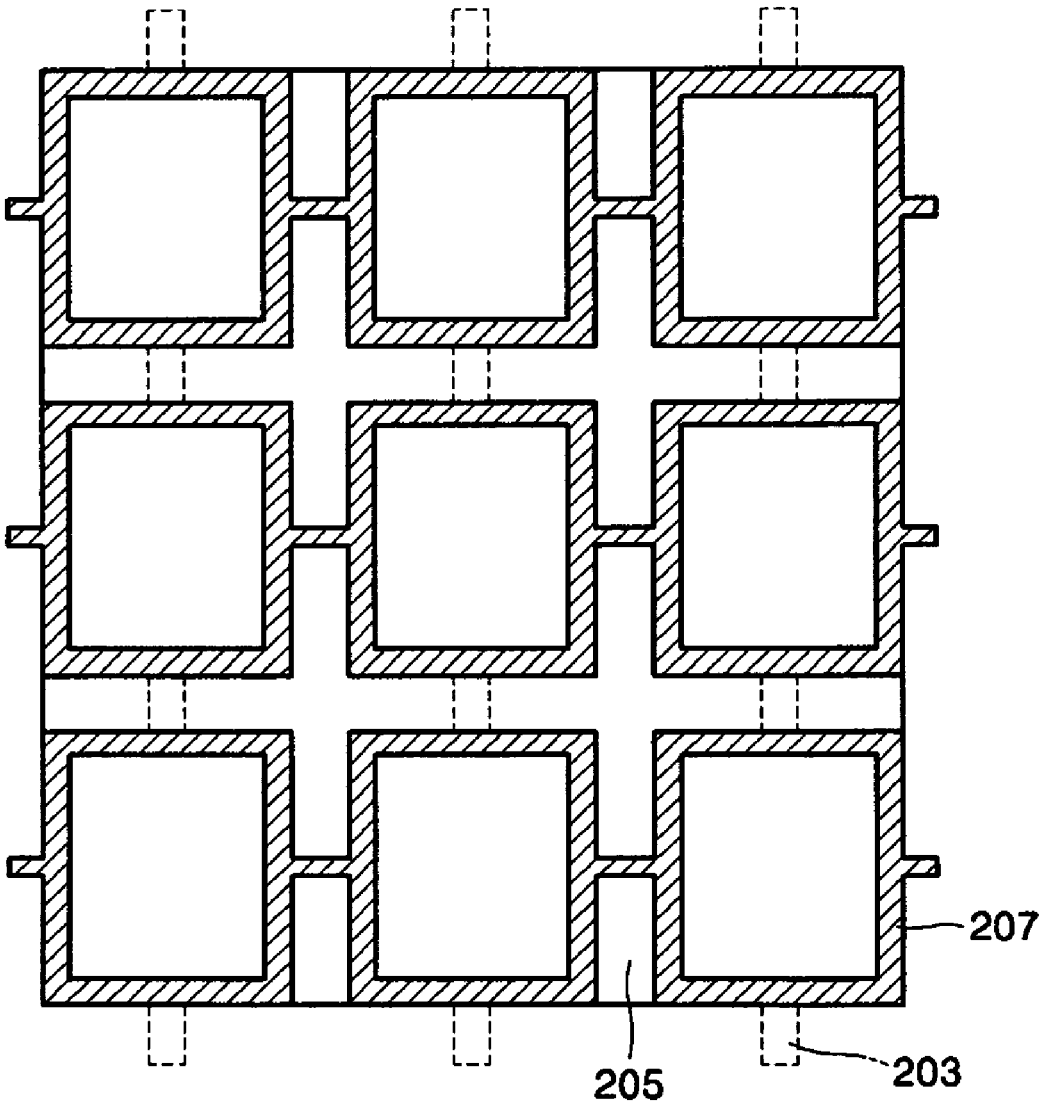
FIG. 6 is a plan view illustrating a configuration of discharge electrodes illustrated in FIG. 3.

As illustrated in FIGS. 3 through 6, electrodes that initiate discharge in the discharge spaces 220, for example, the discharge electrodes 207 and 206 (hereinafter, referred to as X electrodes and Y electrodes), are formed on the barrier ribs 205. The X and Y electrodes 207 and 206 are arranged such that discharge due to a difference between voltages applied to the X and Y electrodes 207 and 206 can start on surfaces of the barrier ribs 205 between the X and Y electrodes 207 and 206. Although the X and Y electrodes 207 and 206 are formed on the barrier ribs 205 in the present embodiment, the X and Y electrodes 207 and 206 may be arranged in various patterns and on various locations as long as a surface discharge can occur in the discharge spaces 220 defined by the X and Y electrodes 207 and 206. For example, as illustrated in FIG. 6, the X and Y electrodes 207 and 206 may each have a shape of a rectangular ring and be arranged parallel to each other around the barrier rib sidewalls 205*a*.

The X and Y electrodes 207 and 206 need to be separated from each other by enough distance so that surface discharge can start and spread. However, it is preferable to decrease the distance between the X and Y electrodes 207 and 206 as much as possible, because by doing so, only a low driving voltage is necessary, thus reducing power. Although each of the X and Y electrodes 207 and 206 is illustrated to have a ring shape in FIGS. 3 through 6, the barrier ribs may instead have various other shapes and are in no way limited to just the ring shape. Also, although the X and Y electrodes 207 and 206 may be arranged in various patterns, it is preferable that they are arranged such that discharge can be easily initiated and spread even when a low voltage is applied.

For example, to widen a discharge surface on which discharge occurs by as much as possible, the X and Y electrodes 207 and 206 may be arranged in such a way that ring-shaped Y electrodes 206 are arranged over and under a ring-shaped X electrode 207, respectively, or that ring-shaped X electrodes 207 are arranged over and under a ring-shaped Y electrode 206, respectively. Due to these arrangements, an effect that a discharge surface is enlarged in a height direction of the discharge spaces 220 can be obtained. In this case, to lower an address voltage to be applied between an address electrode 203 and a Y electrode 206, the Y electrode 206 is preferably arranged close to the address electrode 203, that is, close to the rear substrate 202.

The X and Y electrodes 207 and 206 may be arranged so that facing parts of the X and Y electrodes 207 and 206 are arranged on a side or lateral surface of the discharge space 220 so that the gap between these two electrodes is perpendicular to the front substrate 201. In other words, the X electrode 207 is located on the lateral surface of the discharge space 220, and Y electrodes 206 is located on both sides of the X electrode 207 and spaced from the X electrode 207 by a predetermined distance so that facing parts of the X and Y electrodes 207 and 206 are perpendicular to the front substrate 201. In this case, it is preferable that the discharge electrodes 206 and 207 are arranged so that discharge electrodes on a lateral surface of the discharge space 220 are symmetrical to those on an adjacent lateral surface thereof.

Due to this arrangement of the discharge electrodes 206 and 207, an effect in which the discharge surface is extended in a circumferential direction of the discharge spaces 220 can be obtained. Besides, the discharge electrodes 206 and 207 may have other shapes and can be arranged in other patterns. The X and Y electrodes 207 and 206 may be formed using various methods, for example, a printing method, a sandblasting method, a deposition method, and the like. Preferably, the X and Y electrodes 207 and 206 are all arranged over the barrier ribs 205.

As illustrated in FIG. 3, the X and Y electrodes 207 and 206 are preferably arranged so that a part of a lateral (or sidewall) dielectric layer 208 can exist between the X and Y electrodes 207 and 206 to maintain insulation between the X and Y electrodes 207 and 206. It is also preferable that the lateral dielectric layer 208 is formed on the sidewalls 205*a* of barrier ribs 205 and to cover the X and Y electrodes 207 and 206.

Figure 4:
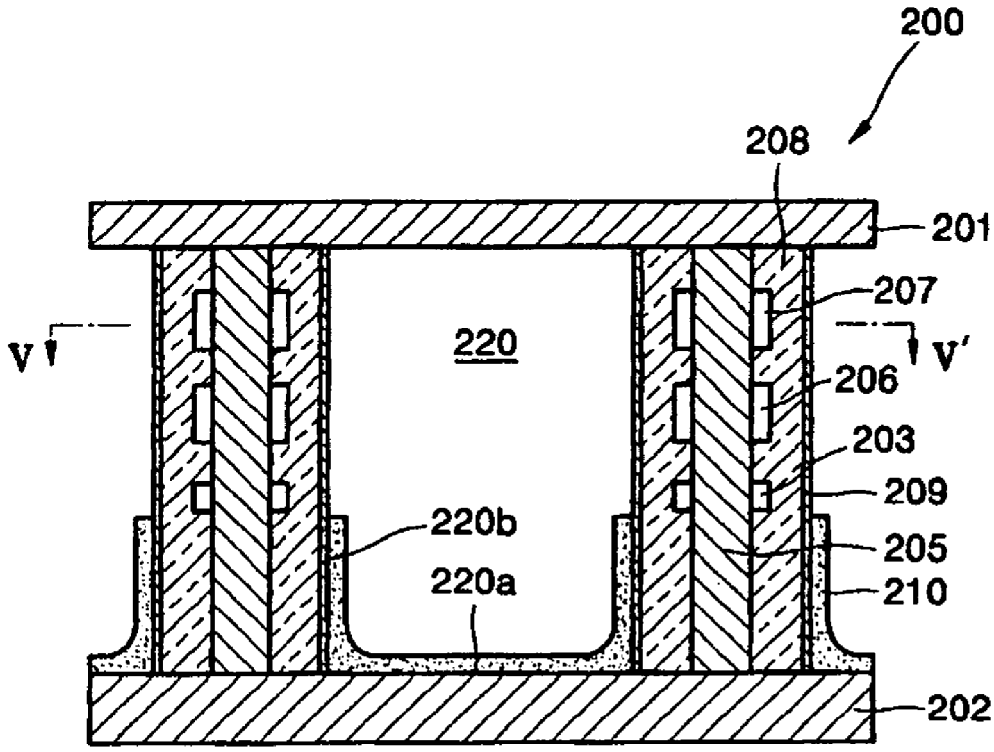
FIG. 4 is a cross-section of a single discharge space of the PDP of FIG. 3.
Figure 5:
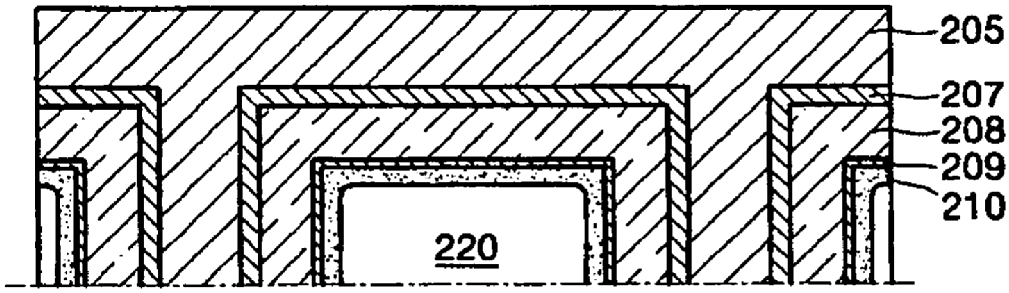
FIG. 5 is a cross-section cut along line V-V of FIG. 4.

Preferably, a protective layer 209, for example, an MgO layer, is formed on the lateral dielectric layer 208 to protect the same. Phosphors 210, which emit visible rays when excited by ultraviolet rays generated from a discharge gas, are formed in the discharge spaces 220 formed by the lateral dielectric layer 208, the rear dielectric layer 204, and the front substrate 201. The phosphors 210 may be formed at any location on the discharge spaces 220. However, as illustrated in FIGS. 3 and 4, the phosphors 210 are preferably formed on a bottom part of the discharge spaces 220 that is close to the rear substrate 202, so as to cover bottom surfaces 220*a* of the discharge spaces 220 and lower parts of lateral (or sidewall) surfaces 220*b* thereof.

A discharge gas, such as, Ne, Xe, or a mixture of Ne and Xe, or the like, is sealed in each of the discharge spaces 220. In the plasma display panel 200 according to the present embodiment, the amount of plasma formed increases due to an increase in a discharge surface and an extension of a discharge area, so that the panel 200 can be driven with low voltage. Hence, the plasma display panel 200 can be driven with low voltage, even when a high-concentration Xe gas is used as a discharge gas, thus increasing luminance efficiency greatly.

A Xe partial pressure in a discharge gas needs to be increased to drive a PDP with high efficiency. However, when the Xe partial pressure increases within the discharge gas, an address discharge margin is apt to decrease. To counter this decrease in the address discharge margin brought on by the increase in Xe partial pressure, the address discharge margin can be increased by reducing a distance between an address electrode and a Y electrode. By doing so, the partial pressure of Xe in the discharge gas can be kept high without the address discharge margin falling to unacceptably low levels. Thus, even when the Xe partial pressure within the discharge gas increases, the PDP can be effectively used. This feature of the present embodiment solves a problem of having a high Xe partial pressure without requiring a high driving voltage. In other words, by designing the PDP as so, the PDP can have both a high Xe partial pressure and drive at low voltages.

An upper opening of each of the discharge spaces 220 is enclosed by the front substrate 201. The front substrate 201 does not include indium tin oxide (ITO) discharge electrodes, bus electrodes, and a dielectric layer that a front substrate of the conventional PDP 1 of FIG. 1 included. In the plasma display panel 200 according to the present embodiment, the losses in visible light transmission through the front substrate 201 is significantly reduced thus increasing greatly the transmittance of visible rays through the front substrate to 90%. This improved front substrate transmittance further allows a low driving voltage for the electrodes. Thus, the panel 200 can be driven with low voltage, consequently maximizing luminance efficiency. The front substrate 201 may be formed of any material as long as the material is transparent. For example, the front substrate 201 may be formed of glass.

Discharge occurring during a sustain discharge period when the PDP 200 illustrated in FIGS. 3 through 6 is driven will now be described. First, when a predetermined address voltage received from an external power source is applied between the address electrodes 203 and the Y electrodes 206, a discharge space 220 to emit light is selected, and wall charges are accumulated near the Y electrode 206 of the selected discharge space 220. Then, when a positive voltage is applied to an X electrode 207 of the selected discharge space 220 and a voltage lower than the positive voltage is applied to the Y electrodes 206, wall charges are moved due to a difference between voltages applied to the X and Y electrodes 207 and 206. The moving wall charges collide with discharge gas atoms located within the selected discharge space 220, thus producing discharge and generating plasma. This discharge is highly likely to occur in a space between the X and Y electrodes 207 and 206 where a strong electrical field is formed.

Figure 1:
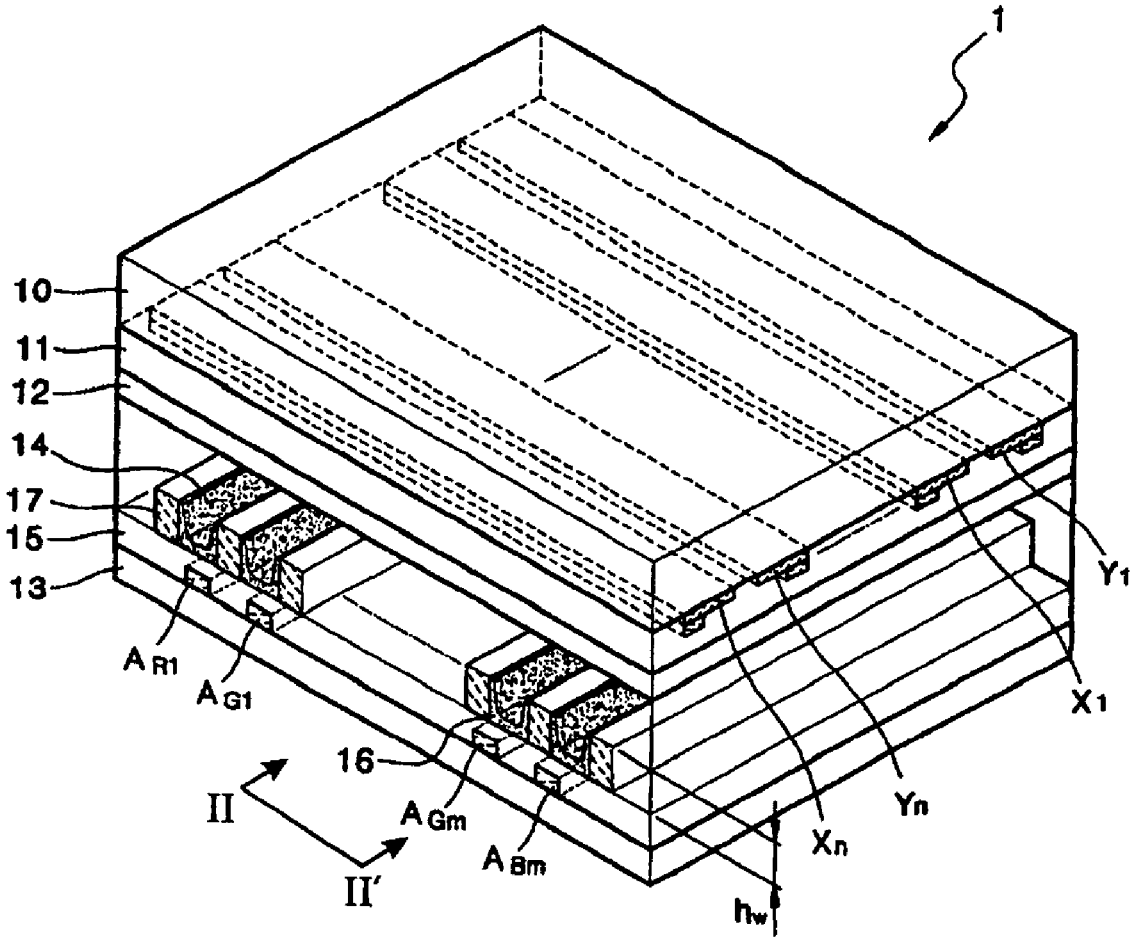
FIG. 1 (PRIOR ART)
FIG. 1 is an internal perspective view of a conventional 3-electrode surface discharge plasma display panel (PDP)
Figure 2:
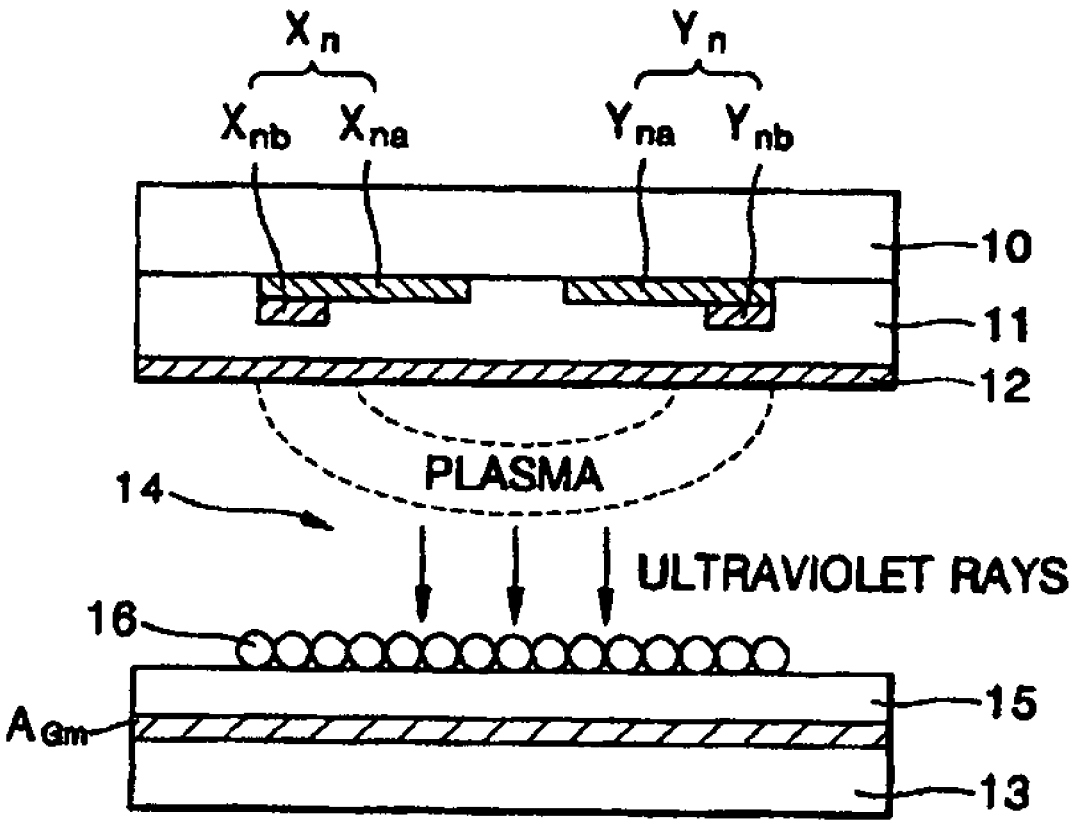
FIG. 2 (PRIOR ART)
FIG. 2 is a cross-section of a unit display cell of the PDP of FIG. 1.

In the present embodiment, the space between the X and Y electrodes 207 and 206 exists on four lateral (or side) surfaces of the discharge space 220, so that the possibility that discharge occurs is drastically increased compared with the conventional art of PDP 1 of FIG. 1 where a space between discharge electrodes exist only on an upper surface of a discharge space. When the sufficiently big difference between voltages applied to X and Y electrodes is kept even when time lapses, electrical fields formed between the X and Y electrodes are concentrated near the lateral surfaces of the discharge space 220 to produce a strong electrical field. Then, discharge is spread to the entire discharge space 220. The discharge in the present embodiment has a ring shape and occurs on the four lateral surfaces of the discharge space 220. The ring-shaped discharge is eventually spread to the center of the discharge space 220. On the other hand, in PDP 1 of FIG. 1, a discharge occurs from only an upper surface of a discharge space and is spread to the center of the discharge space from this upper surface. Therefore, the discharge in the present embodiment is far more effective than the discharge in conventional PDP 1 of FIG. 1.

The plasma produced due to the discharge in the present embodiment is also formed in the shape of a ring around the four lateral surfaces of the discharge space 220 and spreads to the center of the discharge space 220, so that the plasma is sharply enlarged, resulting in a drastic increase in the amount of visible light produced. Due to the spread of the plasma to the center of the discharge space 220, space charges can be utilized to thus enable the PDP in the present embodiment to be driven with low voltage and to increase luminance efficiency.

Since the plasma is concentrated at the center of the discharge space 220 and electrical fields generated by the discharge electrodes 206 and 207 exist on four lateral surfaces of the discharge space, charges are collected at the center of the discharge space 220 and can prevent ion sputtering of the phosphor layer 210 coated in the discharge space 220.

When such discharge is formed and the difference between the voltages applied to the X and Y electrodes 207 and 206 is lower than a discharge voltage, no more discharging occurs, and space charges and wall charges are formed in the discharge space 220. At this time, when the polarities of the voltages applied to the X and Y electrodes 207 and 206 are toggled, a new discharge occurs with the help of the wall charges. Thereafter, the discharge spreads to the entire discharge space 220 and then disappears.

When the polarities of the voltages applied to the X and Y electrodes 207 and 206 are toggled or re-switched with each other again, the initial discharge process resumes. By repeating this process, a stable discharge results. However, the discharge in the present embodiment does not limit the scope of the present invention, and various types of discharge may be used by those of ordinary skill in the art and still be within the scope of the present invention.

Referring to FIG. 3, the PDP 200 includes a front and a rear substrate 201 and 202, at least one barrier rib 205, the discharge electrodes (Y and X electrodes) 206 and 207, the address electrodes 203, the lateral dielectric layer 208, a protective layer 209, and the phosphor layer 210. The front and rear substrates 201 and 202 face each other and are separated from each other by a predetermined distance. The barrier ribs 205 define a plurality of discharge spaces 220 in a space between the front and rear substrates 201 and 202.

The Y electrodes 206 cause an address discharge in spaces between the Y electrodes 207 and the address electrodes 203 and select a particular discharge space from the discharge spaces 220. The X electrodes 207 cause a sustain discharge between the X electrodes 207 and the Y electrodes 206. The discharge electrodes 206 and 207 are arranged in parallel on the barrier ribs 205 in a substrate direction going from the front substrate 201 to the rear substrate 202, to be a predetermined distance away from each other. The substrate direction being a direction that is substantially perpendicular or normal to the surface of the substrate. Preferably, the discharge electrodes 206 and 207 and the address electrodes 203 are arranged on surfaces of each of the barrier ribs 205 that face each of the discharge space 220.

Each of the address electrodes 203 are arranged at a predetermined distance apart from the discharge electrodes 206 and 207 in the substrate direction, thus defining each of the discharge spaces 220 together with the discharge electrodes 206 and 207. As illustrated in FIG. 6, when the address electrodes 203 are arranged to be orthogonal to the discharge electrodes 206 and 207, scan pulses are applied to Y electrodes 206 in a sequence where the Y electrodes 206 are arranged, and an address voltage is applied to an address electrode 203 corresponding to a discharge cell, thus selecting the discharge cell to emit light.

The lateral dielectric layer 208 is coated over the barrier rib 205 on which the discharge electrodes 206 and 207 and the address electrode 203 are arranged. The protective layer 209 is formed on the lateral dielectric layer 208 to protect the lateral dielectric layer 208. The phosphor layer 210 is coated within each of the discharge spaces 220.

In the PDP 200 of FIG. 4, the X electrode 207 is positioned closest to the front substrate 201, then the Y electrode 206 and then address electrode 203 is located closest to the rear substrate 202. In a PDP 300 of FIG. 7, the relative positioning of these three electrodes is changed so that the order from top to bottom is the address electrode 303, the Y electrode 306 and lastly the X electrode 307 are each arranged on a barrier rib 305. In a PDP 400 of FIG. 8, the X electrode 407 is placed closest to the front substrate 401, then the address electrode 403 and lastly the Y electrode 406 is located further from the front substrate 401 than either the address electrode or the X electrode 407. In these embodiments, an address electrode and a Y electrode are arranged in parallel and adjacent to each other to reduce the distance between the address electrode and the Y electrode.

In the PDP 200 of FIG. 4, the X electrode 207, the Y electrode 206, and the address electrode 203 are sequentially arranged on surfaces of the barrier rib 205 that face a discharge space 220 in a direction going from the front substrate 201 to the rear substrate 202. In the PDP 300 of FIG. 7, the X electrode 307, the Y electrode 306, and then the address electrode 303 are arranged on surfaces of the barrier rib 305 that face a discharge space 320, in a direction going from a front substrate 301 to a rear substrate 302.

Figure 8:
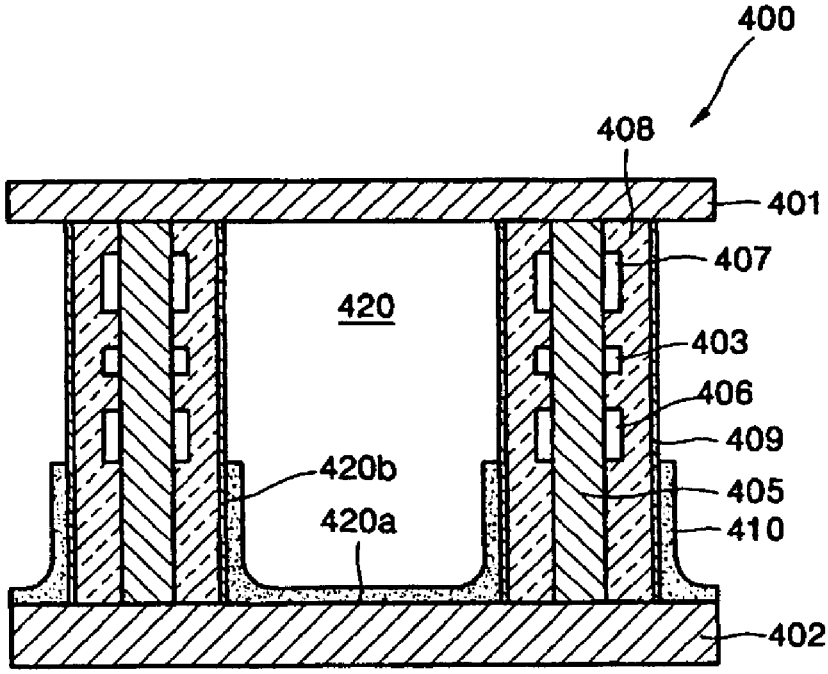

In the PDP 400 of FIG. 8, the X electrode 407, the Y electrode 406, and the address electrode 403 are arranged on surfaces of the barrier rib 405 that face a discharge space 420, in a direction going from a front substrate 401 to a rear substrate 402 in a sequence from the X electrode 407, to the address electrode 403, and to the Y electrode 407. Alternatively, the X electrode 407, the Y electrode 406, and the address electrode 403 may be arranged in a sequence from the Y electrode 406 to the X electrode 407 via the address electrode 403. In other words, the order of positioning of the X, Y and address electrodes on the sidewalls of the barrier ribs can be changed. One design consideration is that the Y electrode and the address electrode are preferably positioned adjacent to each other as opposed to opposite from each other.

Turning now to FIGS. 9 through 14, FIGS. 9 through 14 are cross-sections of a single discharge space of PDPs 500, 600, 700, 800, 900, and 1000 according to other embodiments of the present invention. The embodiments of FIGS. 9 through 14 are similar to the above-described embodiments in that an address electrode and discharge electrodes are not formed on the substrates but on a sidewall of a structure between the substrates so that a distance between the address electrode and the Y electrode can be lowered without compromising image quality or luminance, thus resulting in a highly efficient address discharge possible using small voltages. Hence, the same features as those in previously described PDPs 200, 300 and 400 will not be repeated here in detail.

In PDPs 500, 600, 700 and 800 of FIGS. 9 through 12, a combination of barrier ribs and upper sidewalls are arranged between the two substrates. In these embodiments, the discharge electrodes and the address electrodes are arranged within the upper sidewalls and not in or on the barrier ribs. The PDPs 500, 600 and 700 of FIGS. 9 through 11 further include upper sidewalls 515, 615 and 715, respectively, extending from barrier ribs 505, 605 and 705, respectively, between a barrier rib 505 and a front substrate 501, between a barrier rib 605 and a front substrate 601, and between a barrier rib 705 and a front substrate 701, respectively. As in the PDPs of FIGS. 4, 7 and 8, the PDPs of FIGS. 9, 10 and 11 vary only in order of electrodes in the upper sidewalls. In the PDP 500, a Y electrode 506, an X electrode 507, and an address electrode 503 are arranged within the upper sidewall 515. In the PDP 600, a Y electrode 606, an X electrode 607, and an address electrode 603 are arranged within the upper sidewall 615. In the PDP 700, a Y electrode 706, an X electrode 707, and an address electrode 703 are arranged within the upper sidewall 715. In the PDP 800, the address electrodes are arranged in the barrier ribs while the discharge electrodes are arranged in the upper sidewalls. Two address electrodes 503, two address electrodes 603, and two address electrodes 703 are arranged within the upper sidewalls 515, 615, and 715, respectively, in parallel to the substrates so that discharge spaces 520, 620, and 720 can each be selected. However, in the embodiment of FIG. 12, two address electrodes 803 are arranged within a barrier rib 805 instead of within the upper sidewall 815 so that a discharge space 820 can be selected.

In other words, in these embodiments of FIGS. 9 through 12, the barrier ribs do not entirely fill the gap between the two substrates. Instead, they only partially fill the gap, the remainder of the gap being filled in by the upper sidewalls. Thus, the combination of the upper sidewalls and the barrier ribs account for the entire gap between the two substrates. In addition, the discharge spaces are surrounded by the combination of the barrier ribs and the upper sidewalls, not just the barrier ribs only.

Figure 9:
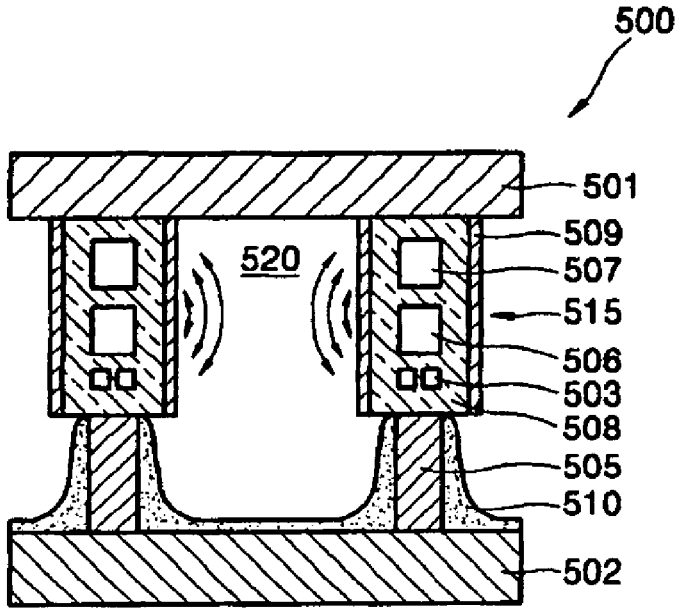
Figure 10:
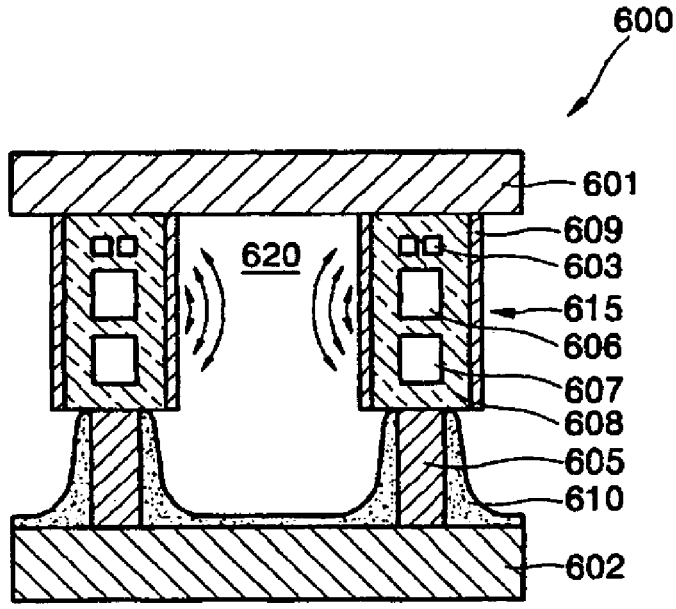
Figure 11:
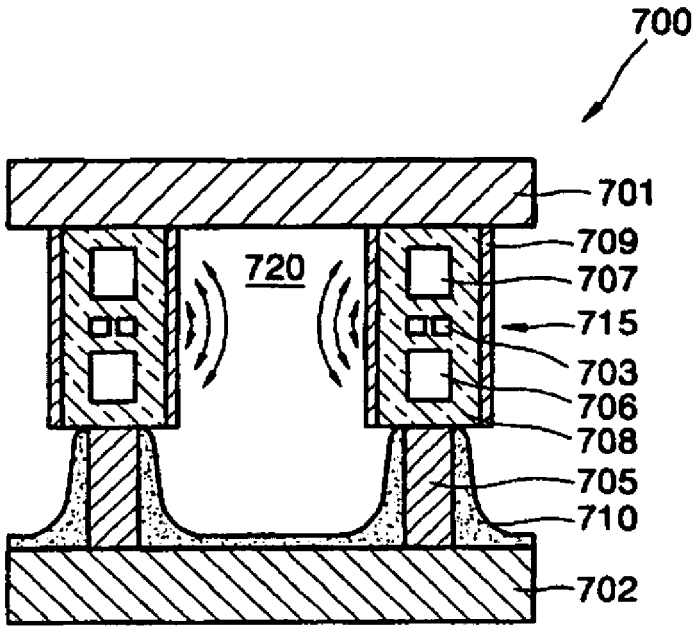
Figure 12:
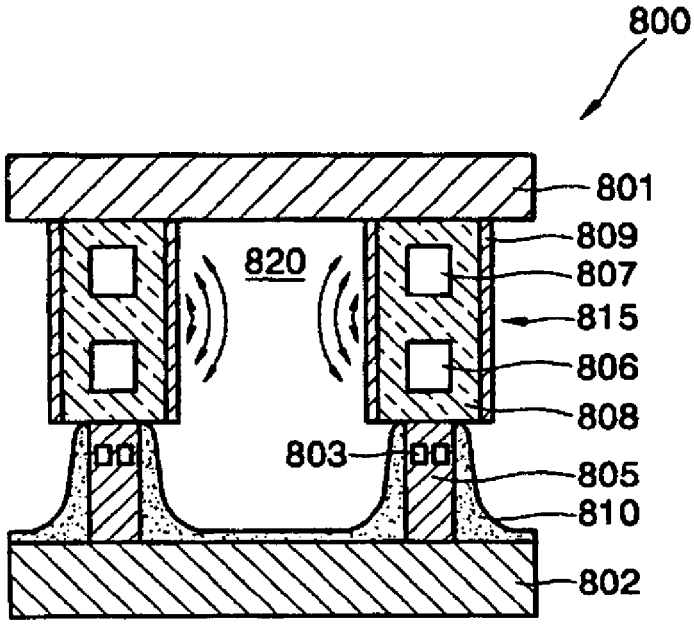

In addition, in the embodiments of FIGS. 9 through 11, the address electrodes and the discharge electrodes are embedded within or arranged within these upper sidewalls and not within the barrier ribs. Further, the address electrodes are split into two strands instead of one. FIGS. 9, 10 and 11 differ from each other merely in the relative positioning of the X, Y and address electrodes from each other as in the case of FIGS. 4, 7 and 8. In the case of FIG. 12, only the discharge electrodes are arranged within the upper sidewalls while the address electrodes are arranged within the barrier ribs.

Figure 7:
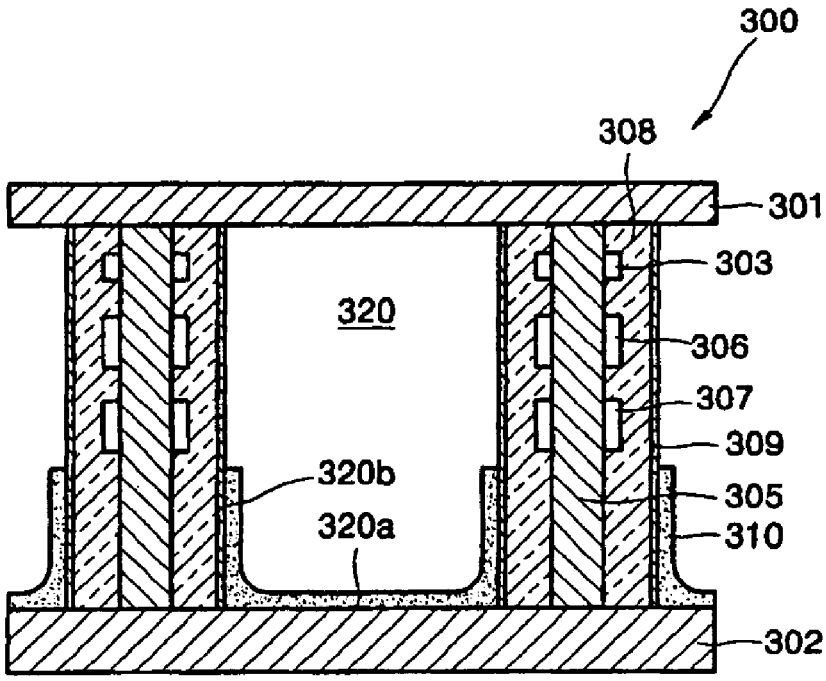
FIGS. 7 through 14 are cross-sections of a single discharge space of PDPs according to other embodiments of the present invention.
Figure 13:
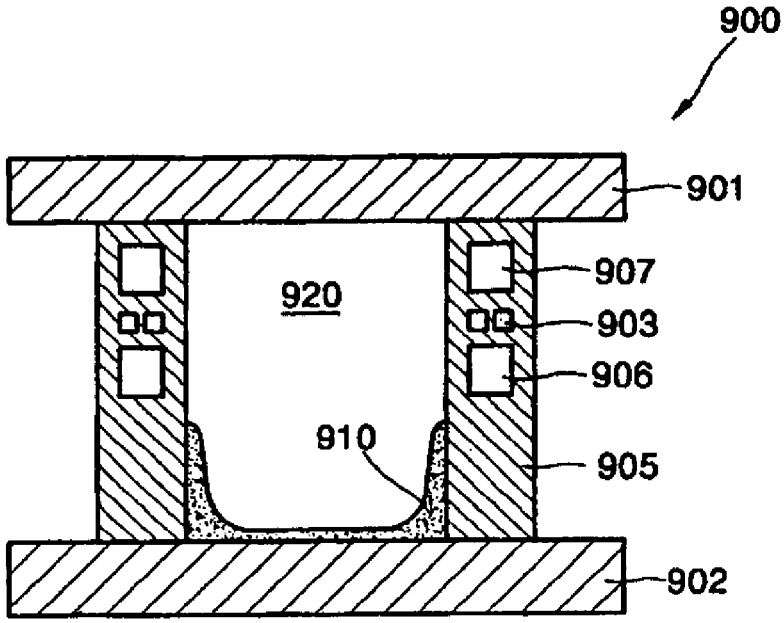
Figure 14:
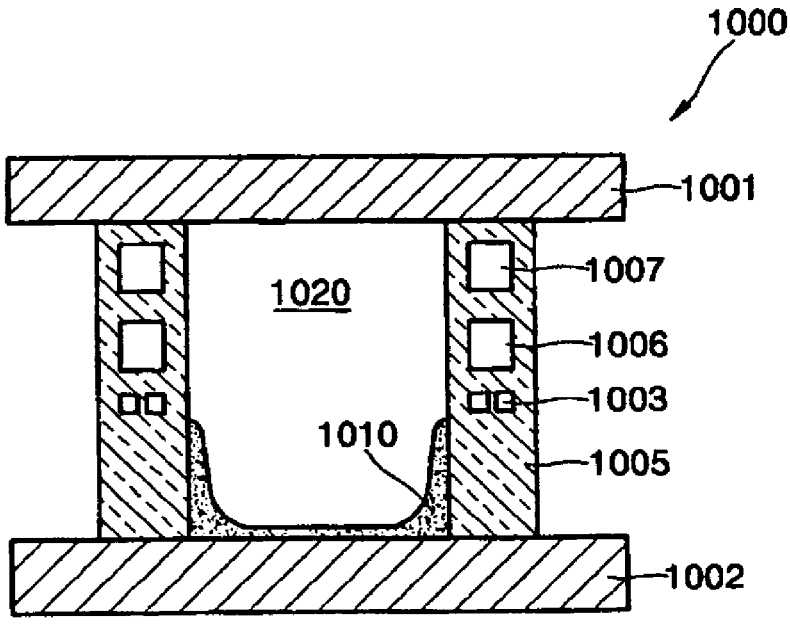

Turning now to FIGS. 13 and 14, unlike the embodiments of FIGS. 4, 7 and 8, the discharge electrodes and the address electrodes of FIGS. 13 and 14 are formed within the barrier ribs as opposed to being formed on the barrier ribs. Turning now to FIGS. 13 and 14, in a PDP 900 of FIG. 13, a Y electrode 906, an X electrode 907, and an address electrode 903 are arranged at predetermined intervals within a barrier rib 905 in a substrate direction going from a front substrate 901 to a rear substrate 902 so as to be parallel to one another. In a PDP 1000 of FIG. 14, a Y electrode 1006, an X electrode 1007, and an address electrode 1003 are arranged at predetermined intervals within a barrier rib 1005 in a substrate direction going from a front substrate 1001 to a rear substrate 1002 so as to be parallel to one another. Unlike the embodiments of FIGS. 4, 7 and 8, the electrodes are formed inside and not on the surface of the barrier ribs. In these embodiments, since the Y electrodes 906 and 1006, the X electrodes 907 and 1007, and the address electrodes 903 and 1003 are arranged within and not on the barrier ribs 905 and 1005, the dielectric layer and the protective layers on the lateral walls of the barrier ribs are not necessary for the generation of wall charges. Thus, in the embodiments of FIGS. 13 and 14, no dielectrics for insulating the Y electrodes 906 and 1006, the X electrodes 907 and 1007, and the address electrodes 903 and 1003 from one another are needed.

A Xe partial pressure in a discharge gas needs to be increased to drive a PDP with high efficiency. However, when the Xe partial pressure increases within the discharge gas, an address discharge margin is apt to decrease. To offset this decrease, the address discharge margin can be increased by reducing a distance between an address electrode and a Y electrode. By doing so, the partial pressure of Xe in the discharge gas can be kept high without the address discharge margin falling to unacceptably low levels. Thus, even when the Xe partial pressure within the discharge gas increases, the PDP can be effectively used.

A PDP according to the present invention can be fast driven with low voltage by reducing a distance between an address electrode and a Y electrode. Also, even when a Xe partial pressure within a discharge gas is high, stable address discharge is possible, leading to highly efficient discharge display.

While the present invention has been particularly illustrated and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel, comprising:

a pair of substrates arranged at an interval to face each other;

a plurality of barrier ribs arranged between ones of the pair of substrates and defining a plurality of discharge spaces between facing surfaces of the substrates;

a plurality of address electrodes arranges within ones of the plurality of barriers ribs; and a plurality of discharge electrodes arranged within ones of the plurality of barrier ribs.

2. The plasma display panel of claim 1, the discharge electrodes and the address electrodes are arranged to be parallel to the substrates.

3. The plasma display panel of claim 1, ones of the plurality of address electrodes extending in a direction perpendicular to ones of the plurality of electrodes.

4. The plasma display panel of claim 1, each of said discharge electrodes comprise:

a Y electrode adapted to select a discharge space to emit light from the discharge spaces by producing an address discharge between the Y electrode and the address electrode; and an X electrode adapted to produce a sustain discharge between the Y electrode and the X electrode.

5. The plasma display panel of claim 4, the X electrodes, the Y electrodes, and the address electrodes being sequentially arranged between the substrates.

6. The plasma display panel of claim 4, the X electrodes, the address electrodes, and the Y electrodes being sequentially arranged between the substrates.

7. A plasma display panel, comprising:

a front substrate and a rear substrate arranged at a predetermined interval to face each other;

at least one barrier rib partitioning a space between the front and rear substrates into a plurality of discharge spaces;

discharge electrodes arranged at predetermined intervals on the barrier rib in a substrate direction going from the front substrate to the rear substrate such that the discharge electrodes are parallel to each other; and an address electrode arranged a predetermined distance apart from the discharge electrodes in the substrate direction, defining each of the discharge spaces in cooperation with the discharge electrodes, the discharge electrodes and the address electrodes area arranged on surfaces of the barrier rib that face each of the discharge spaces.

8. The plasma display panel of claim 7, the discharge electrodes and the address electrode are arranged to be parallel to the front and rear substrates.

9. The plasma display panel of claim 7, the address electrode are extended perpendicular to the discharge electrodes.

10. The plasma display panel of claim 7, further comprising a dielectric layer coated over portions of the barrier rib where the discharge electrodes and the address electrode are arranged, the dielectric layer adapted to prevent charges from being directly moved between the electrodes.

11. The plasma display panel of claim 10, further comprising a protective layer formed on the dielectric layer and adapted to protect the dielectric layer.

12. The plasma display panel of claim 7, the discharge electrodes comprise:

a Y electrode adapted to select a discharge space to emit light from the discharge spaces by producing an address discharge between the Y electrode and the address electrode; and an X electrode adapted to produce a sustain discharge between the Y electrode and the X electrode.

13. The plasma display panel of claim 12, the X electrode, the Y electrode, and the address electrode being sequentially arranged on the surfaces of the barrier rib that face the discharge space, in the direction going from the front substrate to the rear substrate.

14. The plasma display panel of claim 12, the address electrode, the Y electrode, and the X electrode being sequentially arranged on the surfaces of the barrier rib that face the discharge space, in the direction going from the front substrate to the rear substrate.

15. The plasma display panel of claim 12, the X electrode, the address electrode, and the Y electrode being sequentially arranged on the surfaces of the barrier rib that face the discharge space, in the direction going from the front substrate to the rear substrate.

16. The plasma display panel of claim 12, the Y electrode, the address electrode, and the X electrode being sequentially arranged on the surfaces of the barrier rib that face the discharge space, in the direction going from the front substrate to the rear substrate.

17. A plasma display panel, comprising:

a pair of substrates arranged at a predetermined interval to face each other;

at least one barrier rib partitioning a space between the substrates into a plurality of discharge spaces;

discharge electrodes arranged at predetermined intervals between the substrates;

an address electrode arranged a predetermined distance apart from the discharge electrodes in a direction where the substrates are arranged, defining each of the discharge spaces in cooperation with the discharge electrodes;

a dielectric layer coated over portions of the barrier rib where the discharge electrodes and the address electrode are arranged;

a protective layer formed on the dielectric layer and arranged to protect the dielectric layer; and a phosphor layer coated within the discharge space, the discharge electrodes and the address electrode are arranged on a surface of the barrier rib that face each of the discharge spaces.

18. The plasma display panel of claim 17, the discharge electrodes comprise:

a Y electrode adapted to select a discharge space to emit light from the discharge spaces by producing an address discharge between the Y electrode and the address electrode; and an X electrode adapted to produce a sustain discharge between the Y electrode and the X electrode.

19. The plasma display panel of claim 18, the X electrode, the address electrode, and the Y electrode being sequentially arranged between the substrates.

20. A plasma display panel, comprising:

a pair of substrates arranged at a predetermined interval to face each other;

at least one barrier rib partitioning a space between the substrates into a plurality of discharge spaces:

discharge electrodes arranged at predetermined intervals between the substrates;

an address electrode arranged a predetermined distance apart from the discharge electrodes in a direction where the substrates are arranged, defining each of the discharge spaces in cooperation with the discharge electrodes;

a dielectric layer coated over portions of the barrier rib where the discharge electrodes and the address electrode are arranged;

a protective layer formed on the dielectric layer and arranged to protect the dielectric layer; and a phosphor layer coated within the discharge space, the discharge electrodes comprise:

a Y electrode adapted to select a discharge space to emit light from the discharge spaces by producing an address discharge between the Y electrode and the address electrode; and an X electrode adapted to produce a sustain discharge between the Y electrode and the X electrode, the X electrode, the Y electrode, and the address electrode being sequentially arranged between the substrates.

21. A plasma display panel, comprising:

a front substrate and a rear substrate arranged at a predetermined interval to face each other;

at least one barrier rib partitioning a space between the front and rear substrates into a plurality of discharge spaces;

discharge electrodes arranged at predetermined intervals in a space between the barrier rib and the front substrate, in a substrate direction going from the front substrate to the barrier rib;

an address electrode arranged a predetermined distance apart from the discharge electrodes in the substrate direction, defining each of the discharge spaces in cooperation with the discharge electrodes;

a phosphor layer coated within the discharge space; and an upper sidewall extending from the barrier rib toward the front substrate, the upper sidewall arranged between the barrier rib and the front substrate, the discharge electrodes and the address electrode being arranged within the upper sidewall.

22. The plasma display panel of claim 21, further comprising a protective layer arranged on an outer surface of the upper sidewall, the upper sidewall comprising a dielectric that buries the discharge electrodes.

23. The plasma display panel of claim 21, the discharge electrodes comprise:

a Y electrode adapted to select a discharge space to emit light from the discharge spaces by producing an address discharge between the Y electrode and the address electrode; and an X electrode adapted to produce a sustain discharge between the Y electrode and the X electrode.

24. The plasma display panel of claim 23, the X electrode, the Y electrode, and the address electrode being sequentially arranged between the front and rear substrates.

25. The plasma display panel of claim 23, the X electrode, the address electrode, and the Y electrode being sequentially arranged between the front and rear substrates.

* * * * *